US007172501B2

(12) United States Patent
Keuler

(10) Patent No.: US 7,172,501 B2
(45) **Date of Patent: *Feb. 6, 2007**

(54) FLAPPED GRINDING DISK

(75) Inventor: Josef Keuler, Bad Neuenahr-Ahrweiler (DE)

(73) Assignee: RHODIUS Schliefwerkzeuge GmbH & Co. KG (DE)

( * ) Notice: Subject to any disclaimer, the term of this patent is extended or adjusted under 35 U.S.C. 154(b) by 0 days.

This patent is subject to a terminal disclaimer.

(21) Appl. No.: 11/301,455

(22) Filed: Dec. 13, 2005

(65) Prior Publication Data

US 2006/0160480 A1 Jul. 20, 2006

Related U.S. Application Data

(63) Continuation-in-part of application No. 11/060,682, filed on Feb. 16, 2005, now Pat. No. 7,004,829.

(30) Foreign Application Priority Data

Mar. 12, 2004 (DE) ..... 20 2004 004 027 U

(51) Int. Cl.
*B24D 15/00* (2006.01)

(52) U.S. Cl. ..... 451/466; 451/488; 451/527; 451/548

(58) Field of Classification Search ..... 451/466, 451/465, 488, 526, 527, 528, 540, 548
See application file for complete search history.

(56) References Cited

U.S. PATENT DOCUMENTS 2,749,681 A 6/1956 Reidenbach
2,907,147 A * 10/1959 Hall et al. ..... 451/527
3,385,010 A 5/1968 Vorce et al.
3,742,655 A * 7/1973 Oliver ..... 451/488
6,007,415 A 12/1999 Van Osengruggen
6,582,289 B1 * 6/2003 Eisenberg ..... 451/548

FOREIGN PATENT DOCUMENTS

DE 17 85 084 U 10/1958
DE 1652912 4/1971
DE A-40 31 454 4/1992
DE U-92 05 471 7/1992

(Continued)

OTHER PUBLICATIONS

German Search Report, from German Utility Model Application No. 20 2004 004 027.1 dated May 3, 2004.

(Continued)

*Primary Examiner*—Jacob K. Ackun, Jr.
(74) *Attorney, Agent, or Firm*—Graybeal Jackson Haley LLP

(57) ABSTRACT

A flapped grinding disk having a disk- or plate-shaped support including an outer periphery, and a plurality of spaced-apart, discrete groups of grinding flaps forming a plurality of apertures, wherein the flaps overlap each other on the support in the manner of shingles, are secured in an adhesive bed, and define an outer circumference, wherein the radial dimension of the aperture from the outer periphery of the support to the outer circumference is substantially commensurate with the radial dimension of the groups of grinding flaps from the outer periphery of the support to the outer circumference.

8 Claims, 1 Drawing Sheet

FOREIGN PATENT DOCUMENTS

| | | |
|---|---|---|
| DE | A-44 30 229 | 2/1996 |
| DE | U-298 02 791 | 5/1998 |
| DE | U-202 14 389 | 12/2002 |
| WO | WO 99/16583 | 4/1999 |
| WO | WO 00/35634 | 6/2000 |

OTHER PUBLICATIONS

German article entitled, "Besser Arbeiten mit vollem Durchblick" published on Feb. 7, 2004 in the magazine "Eisenwaren-Zeitung" on p. 24, col. 2.

* cited by examiner

FLAPPED GRINDING DISK

CROSS-REFERENCE TO RELATED APPLICATION

This is a continuation-in-part application filed that claims benefit, under 35 USC § 120, of application Ser. No. 11/060,682, filed on 16 Feb. 2005, now U.S. Pat. No. 7,004,829 which claims foreign priority benefits under 35 USC § 119(a) to German patent application no. 20 2004 004 027.1, filed 12 Mar. 2004, which applications are incorporated herein by reference.

BACKGROUND OF THE INVENTION

In the field of abrasive grinding, it is often considered desirable to gauge the degree of material removal during the grinding process to ensure that accurate grinding is taking place, and that only desired material is removed. To this end, apertures formed in the grinding media of rotating grinding elements have been employed to assist a user in making these determinations. The apertures make it possible to constantly monitor the grinding result during grinding. Furthermore, heating of the target workpiece is reduced by the apertures due to intrinsic cooling.

The prior art also recognizes the advantages of flapped grinding discs: those that have a plurality of grinding blades or flaps that are positioned in an overlapping relationship such as shingles. This configuration permits grinding operations to be carried out on contoured or irregular surfaces. Realizing the benefits of both flapped grinding disks and apertured disks, the prior art includes flapped grinding disks that use apertures. For example, a flapped grinding disk employing apertures is known from DE-U-202 14 389 wherein the apertures are segment-shaped, i.e. they are cut off from the periphery by a cut which is guided along a chord.

A similar flapped grinding disk is also known from U.S. Pat. No. 6,007,415, the aperture being able to have any form and segment-shaped apertures specifically again being described.

Flapped grinding disks with a circular periphery and without inspection apertures are known from DE-U-92 05 471, DE-A-40 31 454, DE-A-44 30 229 and WO99/16583.

Grinding and cutting-off disks in which granular abrasive is applied direct to the disk- or plate-shaped support and in which inspection apertures are provided are also known from DE-A-1 652 912, DE-U-298 02 791 and WO00/35634. The inspection apertures are circular openings in the support or cuts with rounded flanks provided at the periphery.

A grinding disk with a disk-shaped support and with grinding blades (flaps) that are fixed overlapping each other in the manner of scales or shingles on the support in an adhesive bed is publicly known. In this grinding disk, the apertures are approximately trapezoidal or have the form of part of a circular ring (annulus), where the edges of the apertures run approximately radially. In this referenced configuration, the aperture is defined on three sides by the grinding flaps.

SUMMARY OF THE INVENTION

The present invention is directed to a flapped grinding disk in which the result of the grinding over the entire grinding layer on the machined workpiece surface can be continuously observed. Unlike the prior art, embodiments of the invention permit user inspection of the entire workpiece subject to material removal through operation of embodiments of the invention; the user at all times can inspect those surfaces of the workpiece that are exposed to the disk at any moment in time.

According to the invention, embodiments of flapped grinding disk comprise a disk- or plate-shaped support having an outer periphery, and a plurality of spaced-apart, discrete groups of grinding flaps defining an outer circumference wherein the flaps comprising each group partially overlap each other on the support in the manner of shingles and are secured thereto in an adhesive bed.

The spacings or apertures established between the groups of grinding flaps extend radially outward from the outer periphery of the support. Because the radial dimension of the aperture from the outer periphery of the support to the outer circumference is substantially commensurate with the radial dimension of the groups of grinding flaps from the outer periphery of the support to the outer circumference, a user may inspect all surfaces of an affected workpiece subject to contact with the groups of grinding flaps.

Because the disk of the invention is operated rotationally, reference herein to a front edge means that portion of a flap last encountering a portion of a workpiece during rotation of the disk prior to exposure of the workpiece to an aperture; reference herein to a rear edge means that portion of a flap first encountering a portion of a workpiece during rotation of the disk after exposure of the workpiece to an aperature.

The rear edge of the apertures need not be exactly radially aligned; deviations of plus/minus approximately 15 degrees are permissible and may function to minimize chatter of the disk during operation thereof in a rotational environment.

A benefit to establishing discrete groups of grinding flaps is that no cut grinding flaps or cut-off remnants of grinding flaps remain there which, during grinding, could become detached from the adhesive bed in which the grinding flaps are fixed on the support. Moreover in the prior art, mere notching of the grinding flaps creates a radially inward annulus of abrasive material and corresponding outer edge, which may interfere with operation of the disk and/or unintentionally engage protrusions in the workpiece, thereby adversely affecting the material removal process.

The grinding flaps of embodiments of the invention preferably overlap each other three- or fourfold in the manner of shingles. In preferred embodiments of the invention, each aperture corresponds generally to removal of three or flour flaps. Moreover, because the aperture is characterized as equivalent to the removal of a group of flaps (as opposed to a die cut of such flaps), those flaps defining the front edge and rear edge of the aperture have enhanced flexural properties in that they are not linked to a pair of adjacent flaps but only one. Thus, the grinding flap defining the front edge of the aperture forms a ramp, which contributes to a smooth running of the grinding disk.

The front edge of the aperture also preferably runs approximately radially so that the apertures are approximately trapezoidal. The result is that no parts of grinding flaps that could be torn off during grinding remain at the front edge of the inspection aperture either.

This embodiment of the invention, in which both the front edge and the rear edge of the apertures run approximately radially, produces a field of vision opened by the apertures which allows the grinding result to be seen equally well over the entire radial extent of the apertures.

In flapped grinding disk embodiments of the invention having a diameter of 115 or 125 mm, the grinding flaps have a radial length of e.g. 20 or 25 mm and the apertures accordingly also have a radial length of 20 or, respectively, 25 mm. It has been shown that the integrity of the grinding disk as a whole and that of the disk- or plate-shaped support are hardly impaired by such apertures. A slight reinforcement of the support suffices if necessary.

Preferably two or three such apertures are provided, distributed uniformly on the periphery of the grinding disk. Three inspection apertures are particularly preferred. The additional loss of grinding flaps at the trailing edge of the inspection apertures is thereby kept within a justifiable limit.

Taken together, the apertures preferably extend over an angle of 60° to 100°, in particular 75°. If there are three apertures, each aperture then has a width or arc of approximately 25°.

A further advantage of the flapped grinding disk according to the invention is that the tendency of the grinding tool to drift on the workpiece is greatly reduced.

The large radial extent of the inspection apertures results in an optimum inspection of the entire grinding area so that a workman is enabled to minimize the sizes of the ground area and the grinding volume. This is advantageous in particular when grinding weld seams.

Surprisingly it was shown that, in spite of the size of the inspection apertures and the radial course of the trailing and optionally also front edges of the apertures, there is no danger of the grinding disk hooking into irregularities in the workpiece. For example it is possible to grind off protruding nail heads or screw heads without difficulty or safety risk.

The circular outer area of the support can drop away slightly to the outside or be planar. Correspondingly the grinding layer formed by the grinding flaps can also drop away slightly to the outside or be planar.

The flapped grinding disk according to the invention can be manufactured using a support comprising a multilayered fibre support, e.g. glass fibre cloth and jute, metal materials, e.g. iron or aluminum, or plastic. The support is applied in a semi-automatic machine such as is customary for the manufacture of flapped grinding disks. An adhesive (one- or two-component adhesive), e.g. an epoxide adhesive, is applied to one side of the support. Then the grinding flaps are fitted, cut off and pressed on. A plurality of such semi-finished flapped grinding disks is stacked on a mandrel of e.g. 500 mm in length and cured for four to five hours at approx. 120° C. Finally opposite-facing apertures shaped like a part of an annulus are cut out by means of diamond cutting-off disks or punch out, saw out or grind two further.

The supports can also be coated separately. To this end, the circular support is clocked corresponding to the distance between segments in direction of rotation. The exact alignment of the grinding flaps is reached after the support has been completely covered by pressing on with a female mould.

BRIEF DESCRIPTION OF THE DRAWINGS

An embodiment of the invention is explained below with reference to the drawing. There are shown in.

DETAILED DESCRIPTION OF THE EMBODIMENTS

Figure 1:
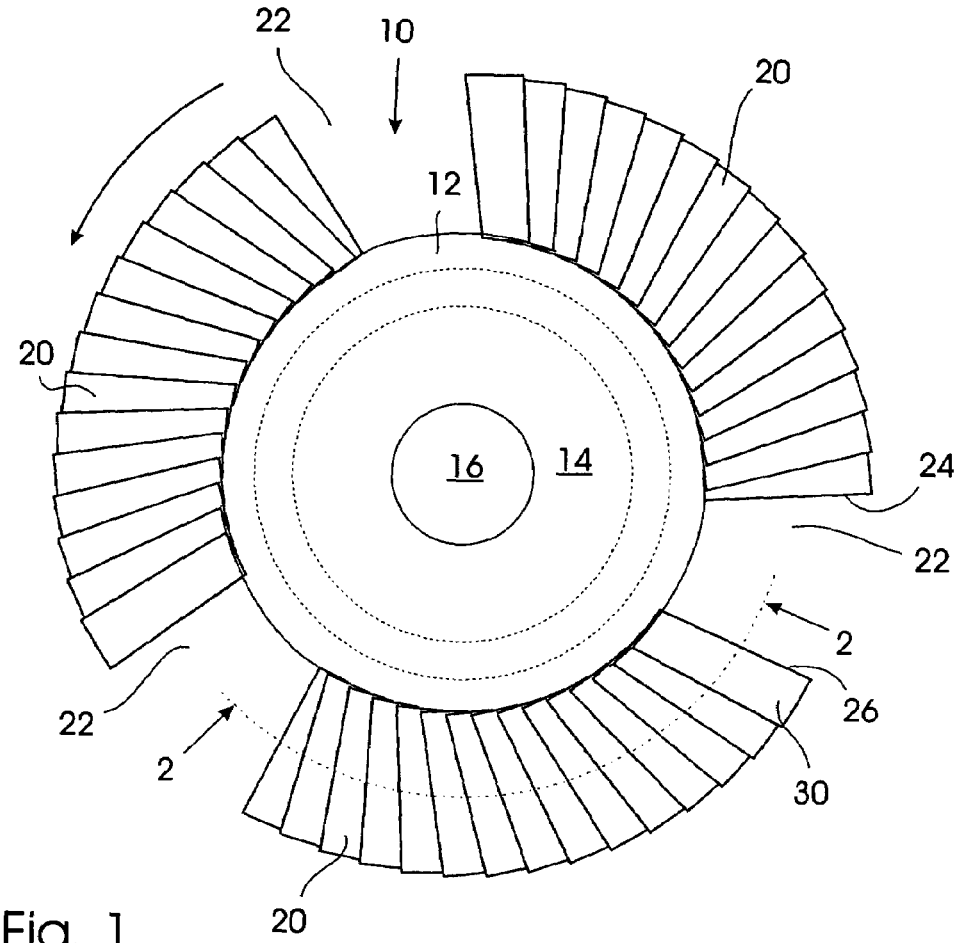
FIG. 1 the flapped grinding disk in a top view.
Figure 2:
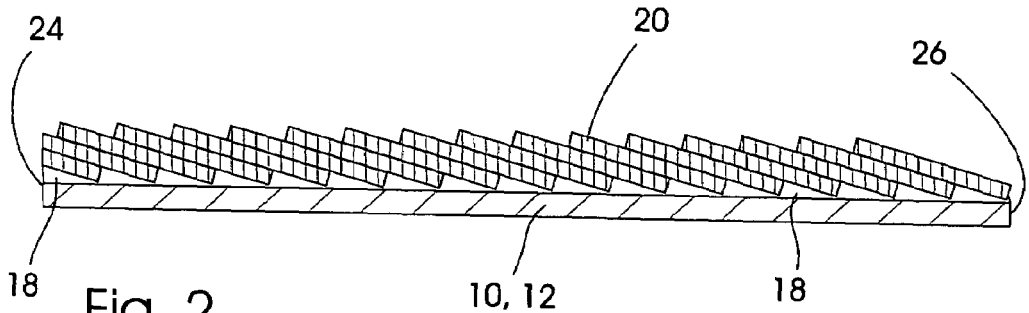
FIG. 2 the flapped grinding disk of FIG. 1 in a section along 2—2.

The flapped grinding disk shown in FIG. 1 has a plate-shaped support 10 with a circular outer area 12 and a recessed or cranked inner area 14, a clamping bore 16 being located in the middle of the inner area 14, with which the flapped grinding disk can be clamped on the clamping pin of an angle grinder. The circular outer area 12 drops away slightly to the outside.

Applied to the plane outer area 12 is an adhesive bed 18, which is equipped with a plurality of grinding flaps 20, which overlap each other in the manner of shingles, so that it is only ever the end area, a few millimetres wide, of each grinding flap 20 that is exposed. The part which is lying in front in the direction of rotation is covered by the grinding flap or flaps 20 lying in front. The individual grinding flaps 20 consist of a base fabric, to which a granular abrasive is applied. The grinding flaps 20 have a radial extent of approximately 20 to 60%, e.g. 40% of the radius of the flapped grinding disk. Corresponding to the inclination of the outer area 12, the grinding flaps 20 also drop away to the outside.

The flapped grinding disk has three apertures 22, arranged at angular distances of 120°, which have the form of a part of an annulus and each cover an angle of approximately 25°. The radial depth of the apertures 22 is equal to the radial extent of the grinding flaps 20, so that the inner edge of the apertures 22 is not equipped with grinding flaps 20.

The direction of rotation of the flapped grinding disk is indicated. Each aperture 22 has a front or leading edge 24 and a rear or trailing edge 26 in the direction of rotation. The rear edge 26 of each aperture 22 travels approximately radially or parallel to the longitudinal extent of the grinding flap 30 attached there. Parts 28 of three or four grinding flaps remain at the rear edge 26 following the cutting out of the aperture 22. The grinding flaps 20 are anchored in the adhesive bed 18 only by the half that is in front in the direction of rotation. This front half is wholly or partially missing from these parts, so that these grinding flaps are only insufficiently secured to the support 10. These parts are therefore removed. The first grinding flap 30 at the rear edge is therefore exposed over its entire width and forms a ramp.

The front edge 24 of each aperture 22 likewise runs approximately radially or parallel to the grinding flap 20 there. Front sections of cut grinding flaps 20 lie under the trailing edge 34 of this grinding flap. As these are fully anchored in the adhesive bed 18, they are not removed.

The grinding flaps 20 each have the form of a sector with a cut-off tip, i.e., the distance between the leading edge and the trailing edge becomes smaller towards the centre of the flapped grinding disk. Furthermore the leading edge and the trailing edge do not run radially, but at an angle of approximately 10° to 15° to the radius, and the grinding flaps 20 are rotated by this angle in the direction of rotation of the flapped grinding disk, the rotation point lying approximately in the middle of the outer edge 36 of the grinding flaps. The imaginary intersection of the leading edge and trailing edge of each grinding flap 20 is thereby at a distance from the centre of the flapped grinding disk that corresponds to this angle of rotation.

The following paragraphs describe a specific embodiment of the invention and are intended to provide a referenced implementation of the invention. Thus, an exemplary flapped grinding disk has an overall diameter of 115 mm, the inner ends of the grinding flaps lying on a circle with a diameter of 75 mm. The apertures 22, three in total, begin at a circle with a diameter of 75 mm and end at the outer diameter of 115 mm.

The flapped grinding disk has 75 grinding flaps 20, so that each grinding flap has a visible width of 4.8 or 4.82 mm at the outer periphery of the flapped grinding disk. The is radial width of the grinding layer, i.e. the length of the grinding flaps 20, is 20 mm, fully usable.

Each grinding flap has an overall width of 18 mm, and the grinding flaps 20 overlap each other fourfold.

Each aperture 22 extends over approximately five grinding flaps, e.g. 25°. At the rear edge 26 of the apertures 22 the parts where cutting has started of three grinding flaps 20 are therefore in each case additionally removed.

While corresponding flapped grinding disks without apertures have supports, which have six to eight layers of glass fiber cloth, in this example the support 10 has twelve layers of glass fiber cloth.

What is claimed:

1. A flapped grinding disk comprising:

a disk- or plate-shaped support having an outer periphery; and a plurality of spaced-apart, discrete groups of grinding flaps forming a plurality of apertures, wherein the flaps overlap each other on the support in the manner of shingles, are secured in an adhesive bed, and define an outer circumference;

wherein the radial dimension of the aperture from the outer periphery of the support to the outer circumference is substantially commensurate with the radial dimension of the groups of grinding flaps such that a radially inward edge of an aperture is not defined by any grinding flap portion.

2. The flapped grinding disk according to claim 1, wherein the grinding flap defining a rear edge of the aperture forms a ramp.

3. The flapped grinding disk according to claim 1, wherein the front edges of the apertures are approximately radially aligned.

4. The flapped grinding disk according to claim 1, wherein the combined aperture arcs range from between 60° to 100°.

5. The flapped grinding disk according to claim 4, wherein the combined aperture arcs are approximately 75°.

6. The flapped grinding disk according to claim 1, wherein two apertures are provided, uniformly distributed on the periphery of the grinding disk.

7. The flapped grinding disk according to claim 1, wherein three apertures are provided, uniformly distributed on the periphery of the grinding disk.

8. The flapped grinding disk according to claim 5, wherein three apertures are provided, uniformly distributed on the periphery of the grinding disk.

* * * * *